US005875894A

United States Patent [19]

Stromme

[11] Patent Number: 5,875,894

[45] Date of Patent: Mar. 2, 1999

[54] COMBINED SANDWICH HOLDER AND PLACE MAT

[76] Inventor: Bonnie S. Stromme, 974 S. Dotsero Dr., Loveland, Colo. 80537

[21] Appl. No.: 932,131

[22] Filed: Sep. 18, 1997

[51] Int. Cl.[6] ..... B65D 65/00

[52] U.S. Cl. ..... 206/541; 229/87.08; 229/938

[58] Field of Search ..... 206/216, 541, 206/545, 548; 229/87.08, 87.09, 938; 383/4

[56] References Cited

U.S. PATENT DOCUMENTS 4,618,992 10/1986 La Grotteria ..... 229/87.08
5,042,666 8/1991 Dolenc .
5,199,792 4/1993 Roosa .
5,205,476 4/1993 Sorenson .
5,221,040 6/1993 Sorenson .
5,560,945 10/1996 Geddes et al. ..... 229/87.08

*Primary Examiner*—Jacob K. Ackun
*Attorney, Agent, or Firm*—William E. Hein

[57] ABSTRACT

A reusable sandwich holder may be quickly and easily wrapped around a sandwich and also serves as a place mat over which the sandwich may be eaten once unwrapped. The sandwich holder includes a decorative cloth outer cover and a plastic inner liner that maintains the freshness of a sandwich wrapped therein. The sandwich holder may be washed, either by hand or in a clothes washer, to permit its repeated reuse.

20 Claims, 1 Drawing Sheet

COMBINED SANDWICH HOLDER AND PLACE MAT

BACKGROUND AND SUMMARY OF THE INVENTION

This invention relates generally to sandwich holders and, more particularly, to a sandwich holder that may be quickly wrapped around a sandwich and that also functions as a place mat over which the sandwich may be eaten when unwrapped.

Several common products are known in the prior art for retaining sandwiches. They include plastic wrap, aluminum foil, and plastic bags, with and without zippered openings. Plastic wrap material is expensive, lacks adhesiveness, and cannot be reused. Aluminum foil material is even more expensive, is difficult to fold neatly around a sandwich, imparts a metallic odor and taste to the wrapped sandwich, and is also difficult to reuse. Plastic bags, like plastic wrap, are not environmentally friendly in that they are not biodegradable. They are also expensive and tear easily when washed in an attempt to reuse them.

The present invention provides a reusable sandwich holder that may be easily wrapped around a sandwich and that also serves as a place mat over which the sandwich may be eaten once unwrapped. The sandwich holder of the present invention includes a decorative outer cover and a plastic inner liner that maintains the freshness of a sandwich wrapped therein. The present sandwich holder may be washed, either by hand or in a clothes washer, to permit its repeated reuse.

DETAILED DESCRIPTION OF THE INVENTION

Figure 1:
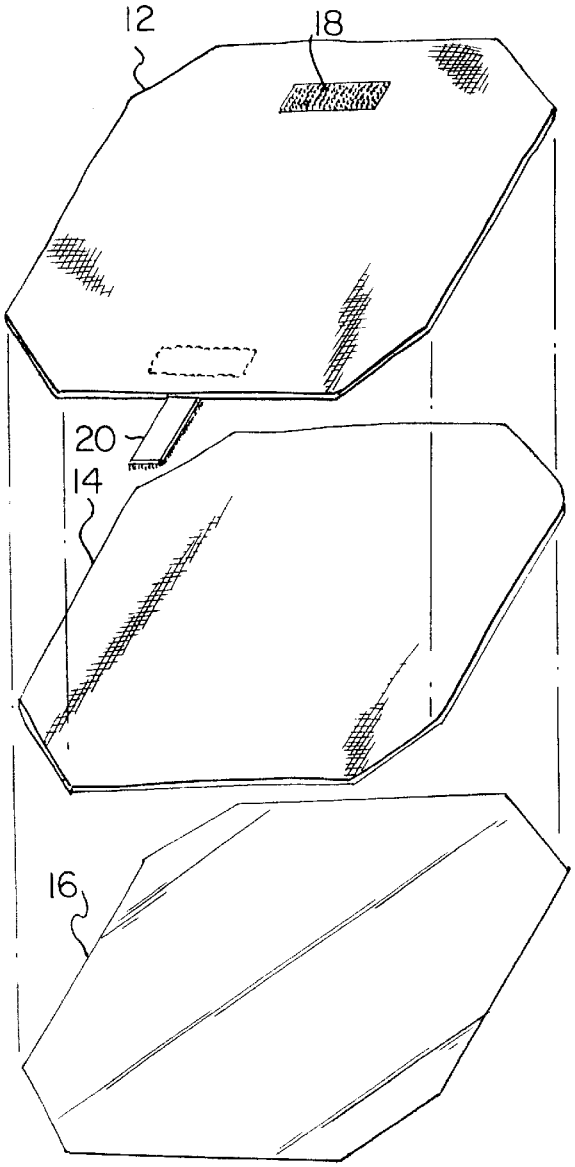
FIG. 1 is an exploded view illustrating the three layers comprising the sandwich holder of the present invention.

Referring now to FIG. 1, there are shown three material layers 12, 14, 16 from which the sandwich holder of the present invention is fabricated. Layers 12 and 14 may comprise cloth fabric of the type readily available at retail fabric stores. Cotton/polyester blend fabrics are preferred over 100% cotton fabrics since the blended fabrics do not shrink when washed, as do the 100% cotton fabrics. Such cotton/polyester fabrics typically have a bright or outside surface and a dull or inside surface. The outside surface may be a solid color, or it may be patterned. Layer 12 is positioned with its outside surface facing upwardly, and layer 14 is positioned with its outside surface facing downwardly. Layer 16 comprises a clear plastic material of the type designated as medium weight #204, 4 mils, manufactured by Kittrich Corporation of Los Angeles, Calif., and marketed nationally by Walmart Corporation. Plastic materials thicker than 4 mils were found to be too thick to fold easily and were difficult to sew when assembling layers 12, 14, 16. Thinner plastic materials lack durability and tear easily during sewing. They also do not retain their shape when washed. Each of the layers 12, 14, 16 is cut from a square piece of material, with each of its four corners cut away at approximately a 45-degree angle. While any size square may be chosen, 13½-inch squares with 3-inch cutaways at each corner have been found to be ideal for wrapping a sandwich of average size. In addition, while it is not necessary to cut away the corners of each of the layers, as illustrated most clearly in FIGS. 1 and 2, doing so eliminates material that would otherwise make folding difficult due to the bulkiness of excess material. Cutting the layers 12, 14, 16 into circular shapes was found to be disadvantageous in that the resulting circular sandwich holder did not completely enclose a sandwich placed thereon. Mating velcro fastener members 18, 20 are sewn or otherwise attached to layer 12. Alternatively, other commercially available fasteners, such as snaps, buttons, buckles, ties or the like may be substituted for velcro fastener members 18, 20 to serve as a closure.

Figure 2:
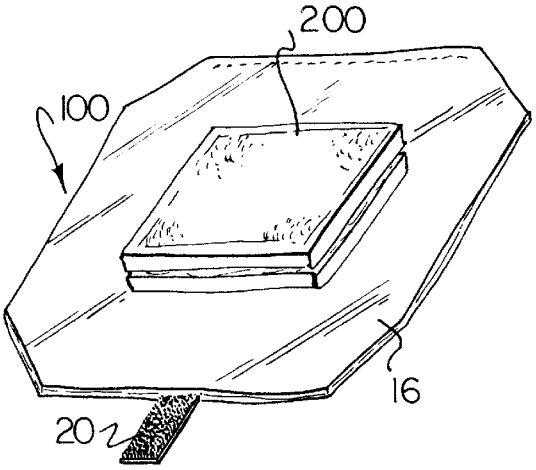
FIG. 2 is a pictorial diagram of the sandwich holder of the present invention illustrating placement of a sandwich thereon prior to wrapping.
Figure 3:
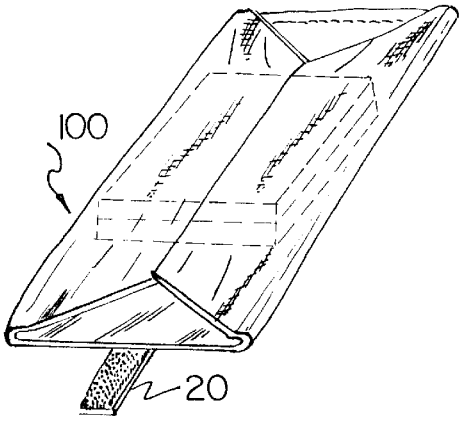
FIG. 3 is a pictorial diagram of the sandwich holder of FIG. 2 illustrating how the two sides are first folded into position over a sandwich.
Figure 4:
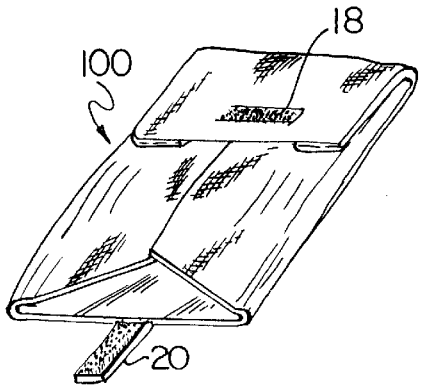
FIG. 4 is a pictorial diagram of the sandwich holder of FIGS. 2 and 3 illustrating the third fold to be made when wrapping a sandwich.
Figure 5:
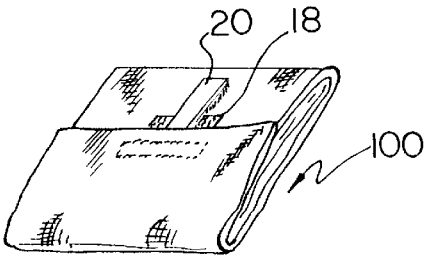
FIG. 5 is a pictorial diagram of the sandwich holder of FIGS. 2–4 illustrating its appearance when completely wrapped around a sandwich.

Once cut and positioned as illustrated in FIG. 1, layers 12, 14, 16 are preferably sewn together at their peripheral edges, using any of a number of known stitching techniques, to result in the assembled sandwich holder 100 illustrated in FIG. 2. In preparation for wrapping a sandwich 200, sandwich holder 100 is placed in its open position on a flat surface, with plastic layer 16 facing upwardly, as illustrated in FIG. 2. Sandwich 200 is generally centered on plastic layer 16, following which the portions of the sandwich holder 100 to the left and right of sandwich 200 are folded up and over sandwich 200 to the positions shown in FIG. 3. Next, the rear portion of sandwich holder 100 is folded up and over sandwich 200 to the position shown in FIG. 4. Finally, the front portion of sandwich holder 100 is folded up and over sandwich 200 to the position shown in FIG. 5, and the velcro fastener member 20 is placed over the velcro fastener member 18 to secure the sandwich holder 100 in the closed position. When it is desired to remove sandwich 200 from within the sandwich holder 100, the preceding steps are performed in reverse order to expose the sandwich 200 in the position on plastic layer 16 illustrated in FIG. 2. In this position, sandwich holder 100 serves as a place mat, over which sandwich 200 may then be eaten.

I claim:

1. A sandwich holder comprising:

a first cloth layer rectangular in shape, said first cloth layer having an outside surface and an inside surface;

a second cloth layer formed in correspondence with the shape of said first cloth layer, said first cloth layer having an outside surface and an inside surface, said first and second cloth layers being positioned in alignment with each other and such that said inside surface of said first cloth layer faces said inside surface of said second cloth layer; and a clear plastic material layer formed in correspondence with the shape of said first and second cloth layers and being positioned in alignment with said first and second cloth layers and against said outside surface of said second cloth layer;

said first and second cloth layers and said clear plastic material layer being attached to each other along aligned peripheral edges thereof.

2. A sandwich holder as in claim 1, further comprising closure means for securing said sandwich holder in a closed position when wrapped around a sandwich.

3. A sandwich holder as in claim 2, wherein said closure means comprises first and second mating velcro fastener members attached to said first cloth layer.

4. A sandwich holder as in claim 1, wherein said first and second cloth layers comprise a cotton/polyester cloth material.

5. A sandwich holder as in claim 1, wherein said clear plastic layer comprises a plastic material having a thickness of four millimeters.

6. A sandwich holder as in claim 1, wherein said first and second cloth materials and said plastic material layer are attached to each other by stitching along the aligned peripheral edges thereof.

7. A sandwich holder as in claim 1, wherein said first and second cloth layers and said clear plastic material layer are formed to be square in shape.

8. A sandwich holder as in claim 1, wherein said first and second cloth layers and said clear plastic material layer are formed such that each of the four corners of each layer is removed, resulting in each of said layers being octagonal in shape.

9. A sandwich holder as in claim 7, wherein said first and second cloth layers and said clear plastic material layer are formed such that each of the four corners of each layer is removed, resulting in each of said layers being octagonal in shape.

10. A method for fabricating a sandwich holder, the method comprising the steps of:

providing a first cloth layer rectangular in shape, said first cloth layer having an outside surface and an inside surface;

providing a second cloth layer formed in correspondence with the shape of said first cloth layer, said first cloth layer having an outside surface and an inside surface, said first and second cloth layers being positioned in alignment with each other and such that said inside surface of said first cloth layer faces said inside surface of said second cloth layer;

providing a clear plastic material layer formed in correspondence with the shape of said first and second cloth layers and being positioned in alignment with said first and second cloth layers and against said outside surface of said second cloth layer; and attaching said first and second cloth layers and said clear plastic material layer to each other along the aligned peripheral edges thereof.

11. A method for fabricating a sandwich holder as in claim 10, further comprising the step of providing a closure means for releasably maintaining said sandwich holder in a closed position.

12. A method for fabricating a sandwich holder as in claim 10, wherein said first and second cloth layers and said clear plastic material layer are formed to be square in shape.

13. A method for fabricating a sandwich holder as in claim 10, wherein said first and second cloth layers and said clear plastic material layer are formed such that each of the four corners of each layer is removed, resulting in each of said layers being octagonal in shape.

14. A method for fabricating a sandwich holder as in claim 12, wherein said first and second cloth layers and said clear plastic material layer are formed such that each of the four corners of each layer is removed, resulting in each of said layers being octagonal in shape.

15. A method for wrapping a sandwich, the method comprising the steps of:

providing a sandwich holder comprising first and second cloth layers, each formed to be correspondingly rectangular in shape, each of said first and second cloth layers having an outside surface and an inside surface and being positioned in alignment with each other and such that said inside surface of said first cloth layer faces said inside surface of said second cloth layer, said sandwich holder further comprising a clear plastic material layer formed in correspondence with the shape of said first and second cloth layers and being positioned in alignment with said first and second cloth layers and against said outside surface of said second cloth layer;

positioning the sandwich holder on a generally flat surface such that said clear plastic material layer faces upwardly;

positioning a sandwich to be wrapped centrally on said clear plastic material layer;

folding a portion of said sandwich holder to the left of said sandwich and a portion of said sandwich holder to the right of said sandwich up and over said sandwich;

folding a portion of said sandwich holder to the rear of said sandwich up and over said sandwich; and folding a portion of said sandwich holder in front of said sandwich up and over said sandwich.

16. A method for wrapping a sandwich as in claim 15, further comprising the step of securing the portions of said sandwich holder to the rear and in front of said sandwich in their folded positions.

17. A method for wrapping a sandwich as in claim 15, wherein said first and second cloth layers and said clear plastic material layer are formed to be square in shape.

18. A method for wrapping a sandwich as in claim 15, wherein said first and second cloth layers and said clear plastic material layer are formed such that each of the four corners of each layer is removed, resulting in each of said layers being octagonal in shape.

19. A method for wrapping a sandwich as in claim 17, wherein said first and second cloth layers and said clear plastic material layer are formed such that each of the four corners of each layer is removed, resulting in each of said layers being octagonal in shape.

20. A sandwich holder comprising:

a first cloth layer having a selected geometric shape, said first cloth layer having an outside surface and an inside surface;

a second cloth layer formed in correspondence with the shape of said first cloth layer, said first cloth layer having an outside surface and an inside surface, said first and second cloth layers being positioned in alignment with each other and such that said inside surface of said first cloth layer faces said inside surface of said second cloth layer; and a clear plastic material layer formed in correspondence with the shape of said first and second cloth layers and being positioned in alignment with said first and second cloth layers and against said outside surface of said second cloth layer;

said first and second cloth layers and said clear plastic material layer being attached to each other along aligned peripheral edges thereof.

* * * * *